United States Patent [19]

Focke et al.

[11] Patent Number: 4,856,538

[45] Date of Patent: Aug. 15, 1989

[54] PROCESS AND APPARATUS FOR TESTING CIGARETTES

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 7,545

[22] Filed: Jan. 28, 1987

[30] Foreign Application Priority Data

Jan. 28, 1986 [DE] Fed. Rep. of Germany ..... 3602428

[51] Int. Cl.[4] ..... A24C 5/35; A24C 5/47; A24C 5/00; B07C 5/00

[52] U.S. Cl. ..... 131/282; 209/536; 209/537

[58] Field of Search ..... 131/282, 283, 94, 280; 209/536, 535, 537; 730/38, 865.6

[56] References Cited

U.S. PATENT DOCUMENTS 3,557,374 1/1971 Schmermund .
4,376,484 3/1983 Seragnoli .

FOREIGN PATENT DOCUMENTS 0100537 2/1984 European Pat. Off. .
1532268 11/1971 Fed. Rep. of Germany .
2542082 4/1976 Fed. Rep. of Germany .
2621409 12/1977 Fed. Rep. of Germany .
2813866 10/1979 Fed. Rep. of Germany .
2919579 12/1979 Fed. Rep. of Germany .
2840617 3/1980 Fed. Rep. of Germany .
3110927 12/1981 Fed. Rep. of Germany .
3304299 9/1983 Fed. Rep. of Germany .
3414753 10/1984 Fed. Rep. of Germany .
3419738 12/1985 Fed. Rep. of Germany .
0166088 1/1986 Fed. Rep. of Germany .
0198282 10/1986 Fed. Rep. of Germany .
2108818 5/1983 United Kingdom .
2120526 12/1983 United Kingdom .
2150807 7/1985 United Kingdom .
2156325 10/1985 United Kingdom .

*Primary Examiner*—V. Millin
*Attorney, Agent, or Firm*—Sughrue, Mion, Zinn, Macpeak & Seas

[57] ABSTRACT

The testing of cigarettes before their packaging is appropriately carried out in the region of magazine shafts (13, 14) of a cigarette magazine (10). To bring a layer (38) of cigarettes of a cigarette group (16) into an exact position for carrying out testing, they are temporarily received in a transverse slide (29) which causes the cigarettes to be aligned as a result of a transverse movement.

19 Claims, 8 Drawing Sheets

PROCESS AND APPARATUS FOR TESTING CIGARETTES

DESCRIPTION

Figure 1:
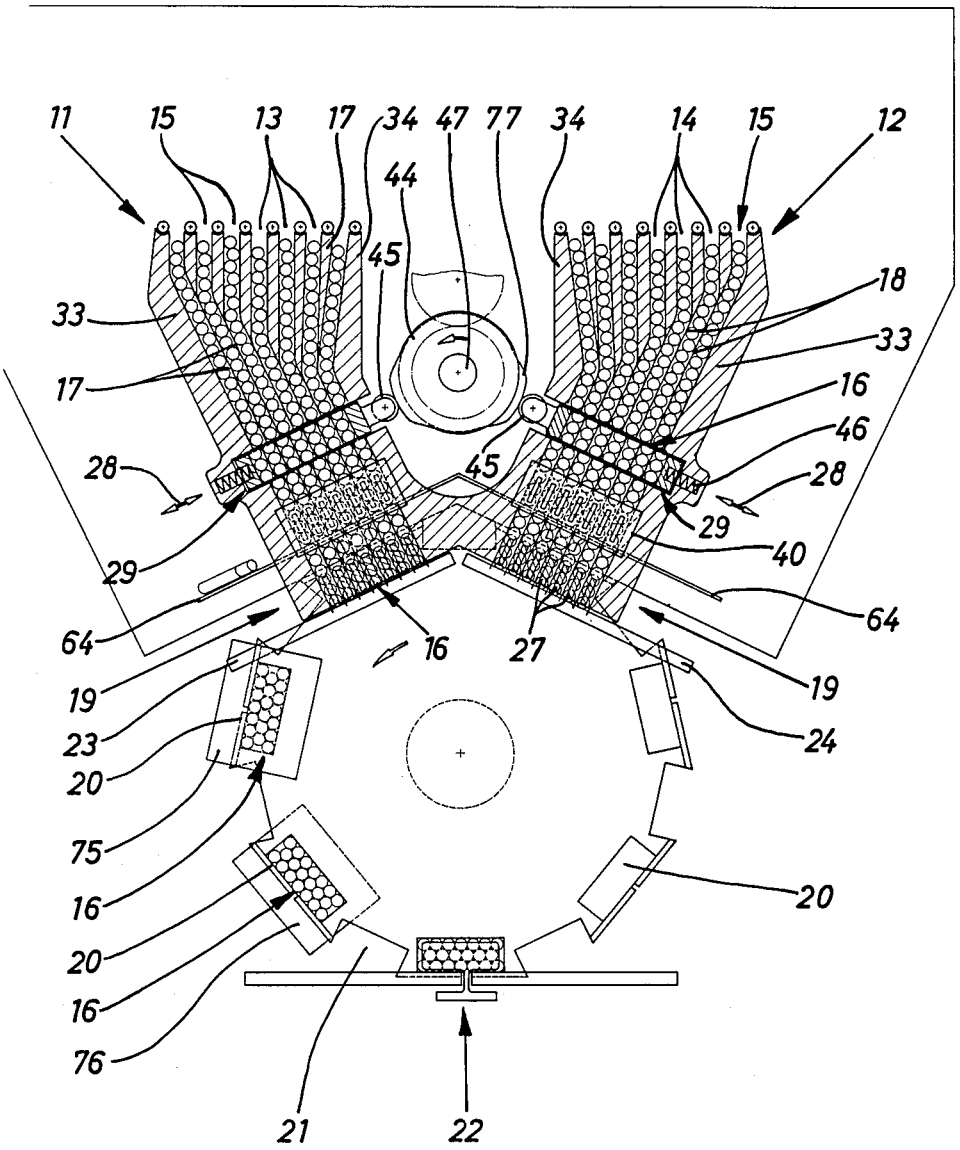

The invention relates to a process for testing cigarettes in the region of vertical or inclined magazine shafts of a cigarette magazine, in which process a cigarette test unit can be advanced towards a cigarette group composed of at least one layer, and defective cigarettes can be separated out during the further transport of these.

It is important to test cigarettes for correct formation, especially for the presence of a sufficient tobacco content and, where appropriate, a filter, before packaging. It is easiest to test the cigarettes in the region of the vertical magazine shafts of the cigarette magazine serving as a cigarette store. In the magazine shafts, cigarettes arranged on top of one another in individual rows are conveyed downwards to a lower main pushing-out plane. Here, cigarette groups corresponding to the content of a cigarette pack are pushed out in the longitudinal direction of the cigarettes. During the downward movement of the cigarettes in the magazine shafts, a cigarette test unit can be applied to check that the cigarettes are intact. The cigarettes identified as defective are subsequently separated out.

The main difficulty of testing the cigarettes inside the magazine shafts is the irregular positioning of the cigarettes. Perfect testing requires that the cigarettes be aligned as exactly as possible with test members of the cigarette test unit. Because of the offset position and dimensional differences of the cigarettes, they are not aligned with one another in one plane from one magazine shaft to another.

A further difficulty is to separate the defective cigarettes out before further processing, in particular before packaging.

The object on which the invention is based is to provide a faultless process and an apparatus for testing cigarettes in the region of the cigarette magazine.

To achieve this object, the process according to the invention is characterized in that the layer or layers of the cigarette group to be tested are (each) aligned in a (transverse) plane for carrying out the test.

Accordingly, the invention is based on the knowledge that, to ensure exact testing, the cigarettes must be aligned in layers. For this purpose, according to the invention, depending on the size of the cigarette group to be tested, one, two or three layers of the cigarette group are simultaneously displaced slightly transversely and brought into an aligned position, specifically by temporarily resting on supporting members aligned in a transverse plane. In this position shifted sideways, the cigarettes are then tested by suitable cigarette test units. The cigarette group is then moved back into the original position and consequently also into the (intermittent) transport flow.

According to a preferred exemplary embodiment, a cigarette group to be tested is received in a transverse slide. This is designed to resemble a portion or cut-out of a particular shaft group of the cigarette magazine. In the initial position of the transverse slide, individual slide walls extend in the plane of the associated shaft walls as a continuation of these. Thus, the cigarettes can run through the transverse slide. For testing, the transverse slide is moved slightly transversely relative to the conveying direction, in particular by an amount corresponding to half the width of a magazine shaft. The cigarette group carried with it is thereby shifted relative to the vertical rows of cigarettes in the magazine shafts. It the same time, the lower cigarettes of the cigarette group (lower layer) rest on the upper ends of the (lower portions of the) magazine shafts. These or their upper supporting ends are aligned in an exact plane, with the result that the entire cigarette group is also aligned.

As regards cigarette magazines with several, especially two shaft groups, a transverse slide is assigned to each shaft group. The two transverse slides are moved synchronously and in coordination by a common actuating member.

When defective cigarettes are detected, these are separated out in the region of a pushing-out plane for defective cigarettes. This is located above the main pushing-out plane. According to the invention, the procedure here is that, where cigarette groups composed of several layers are concerned, a number of cigarettes lying on top of one another which corresponds to the number of layers is pushed out together with the defective cigarette.

Further features of the invention relate to the design of the transverse slides and to members for pushing out the defective and the correct cigarettes.

Figure 2:
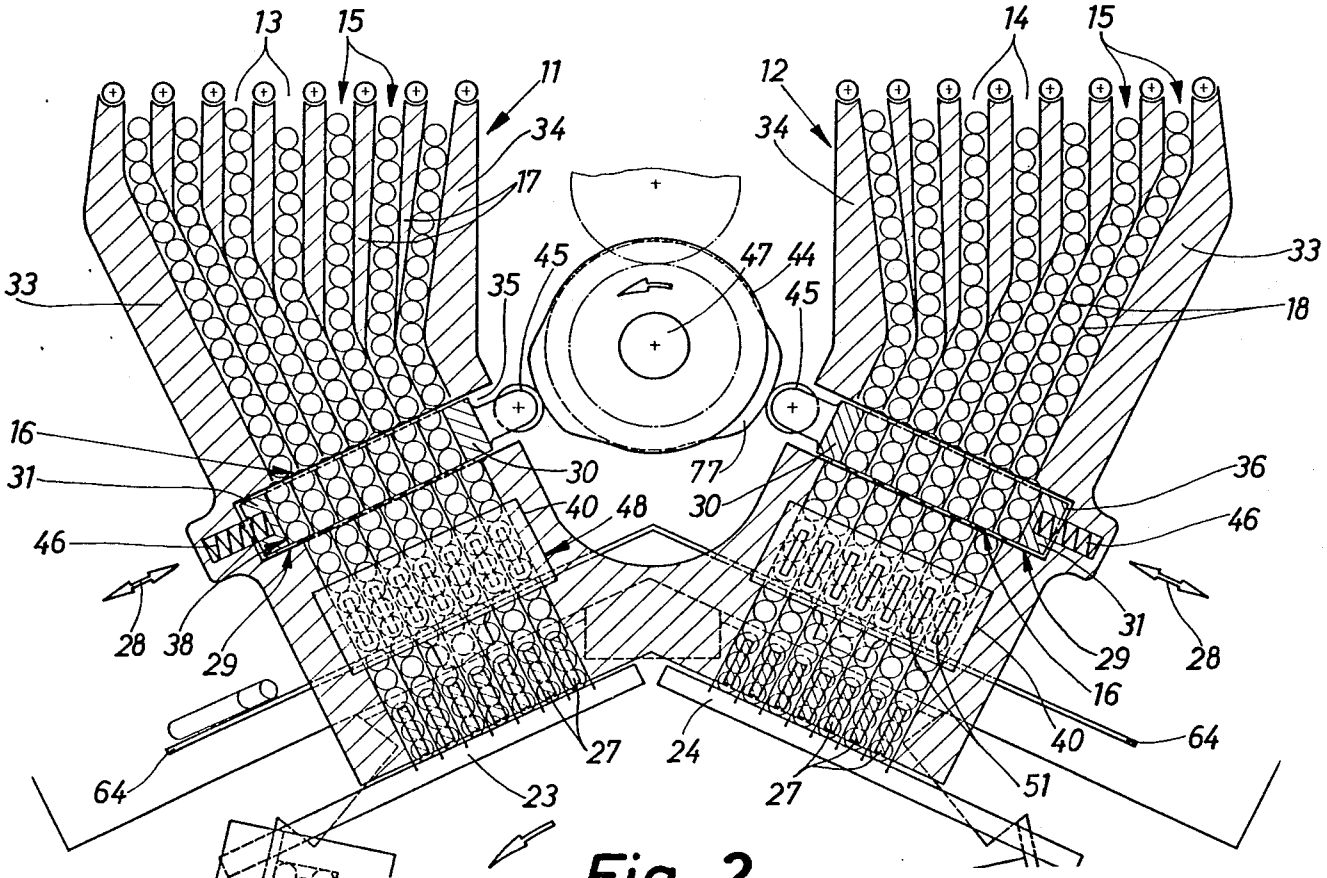
Figure 4:
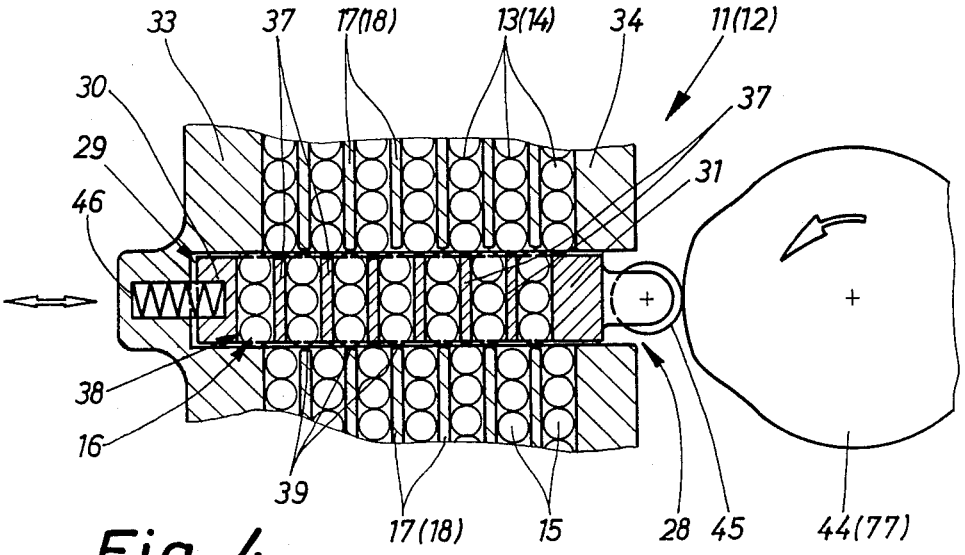
Figure 3:
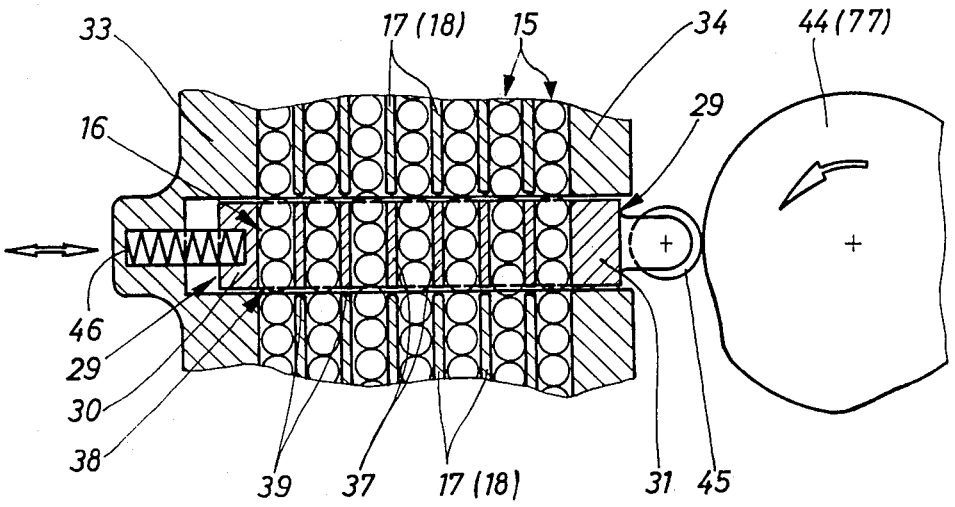
Figure 5:
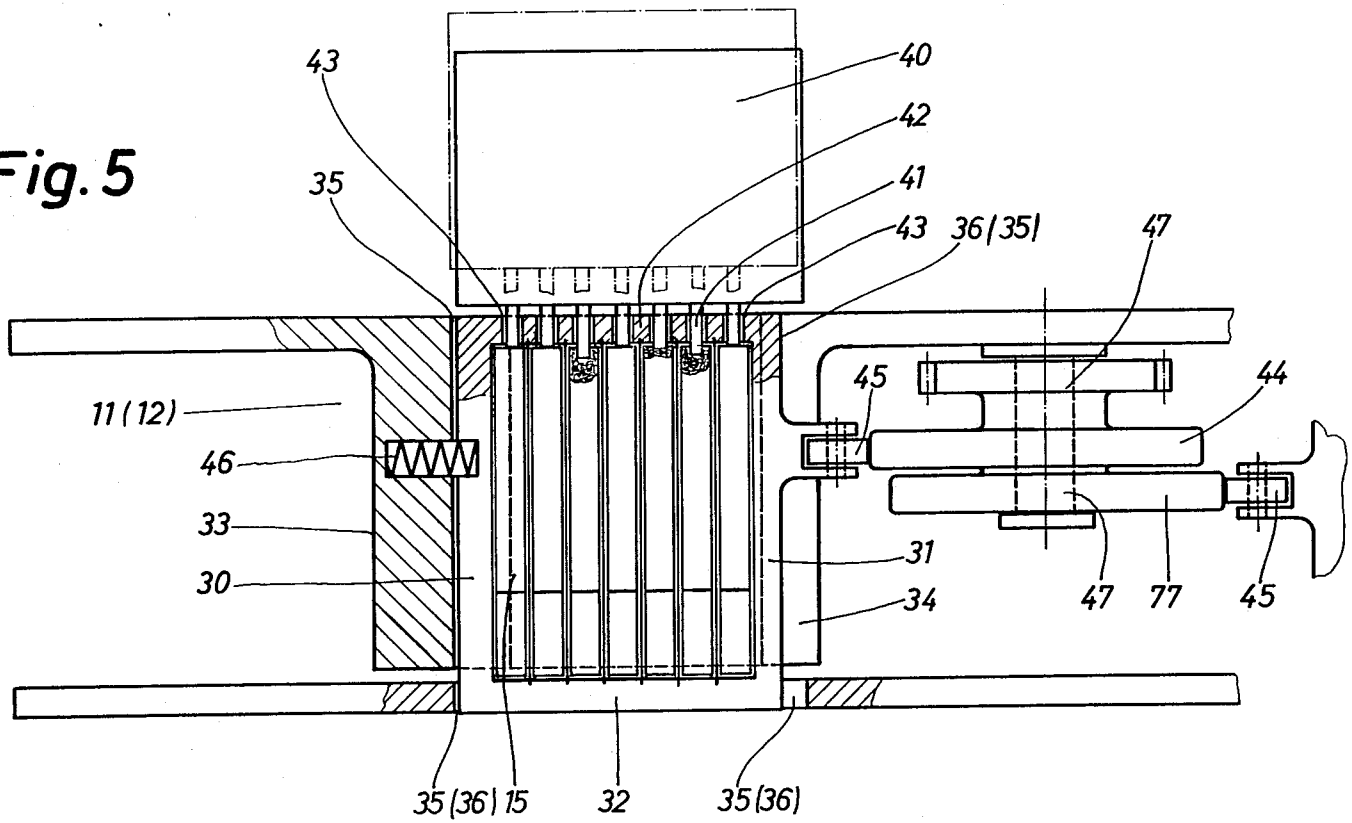
Figure 6:
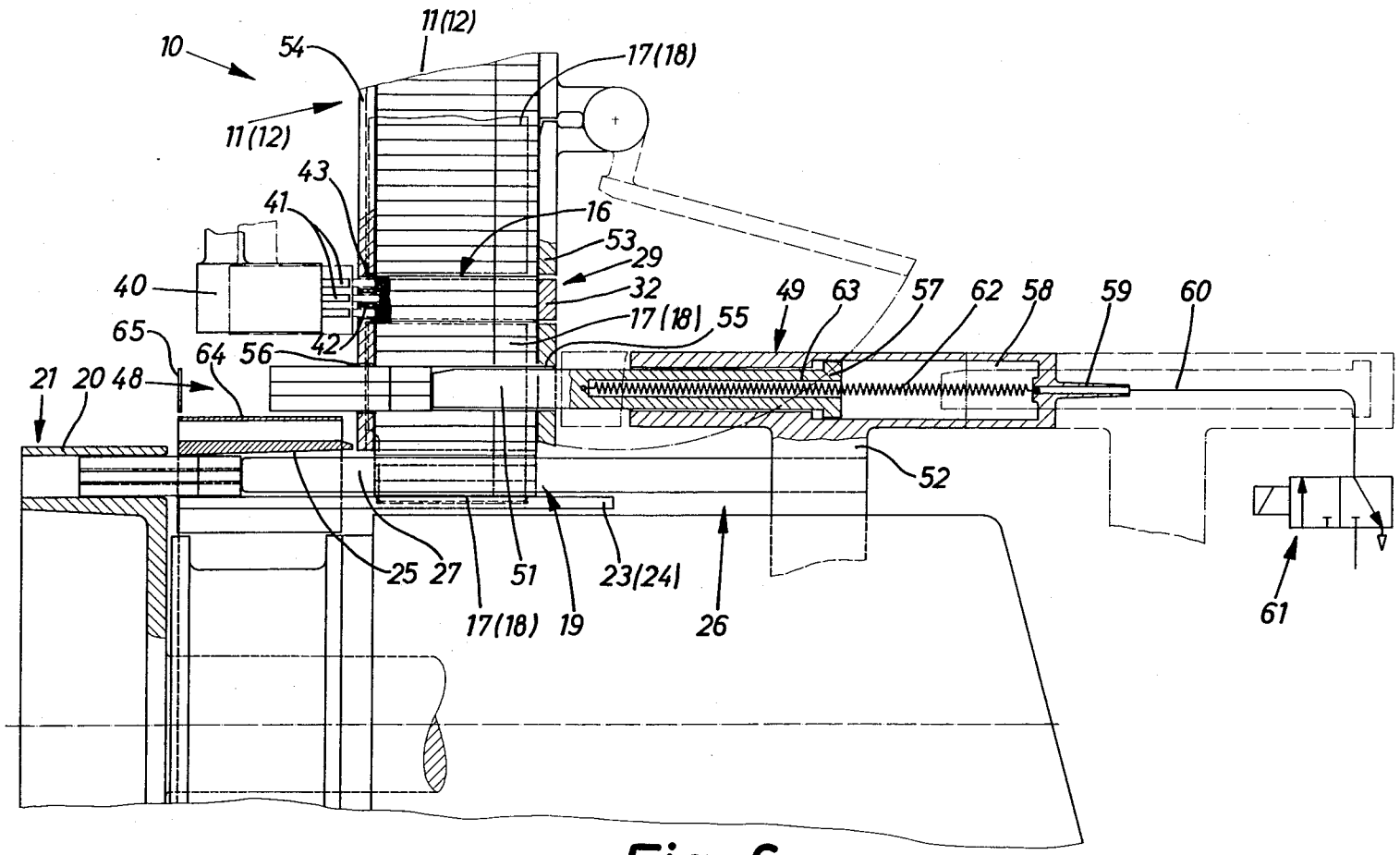
Figure 7:
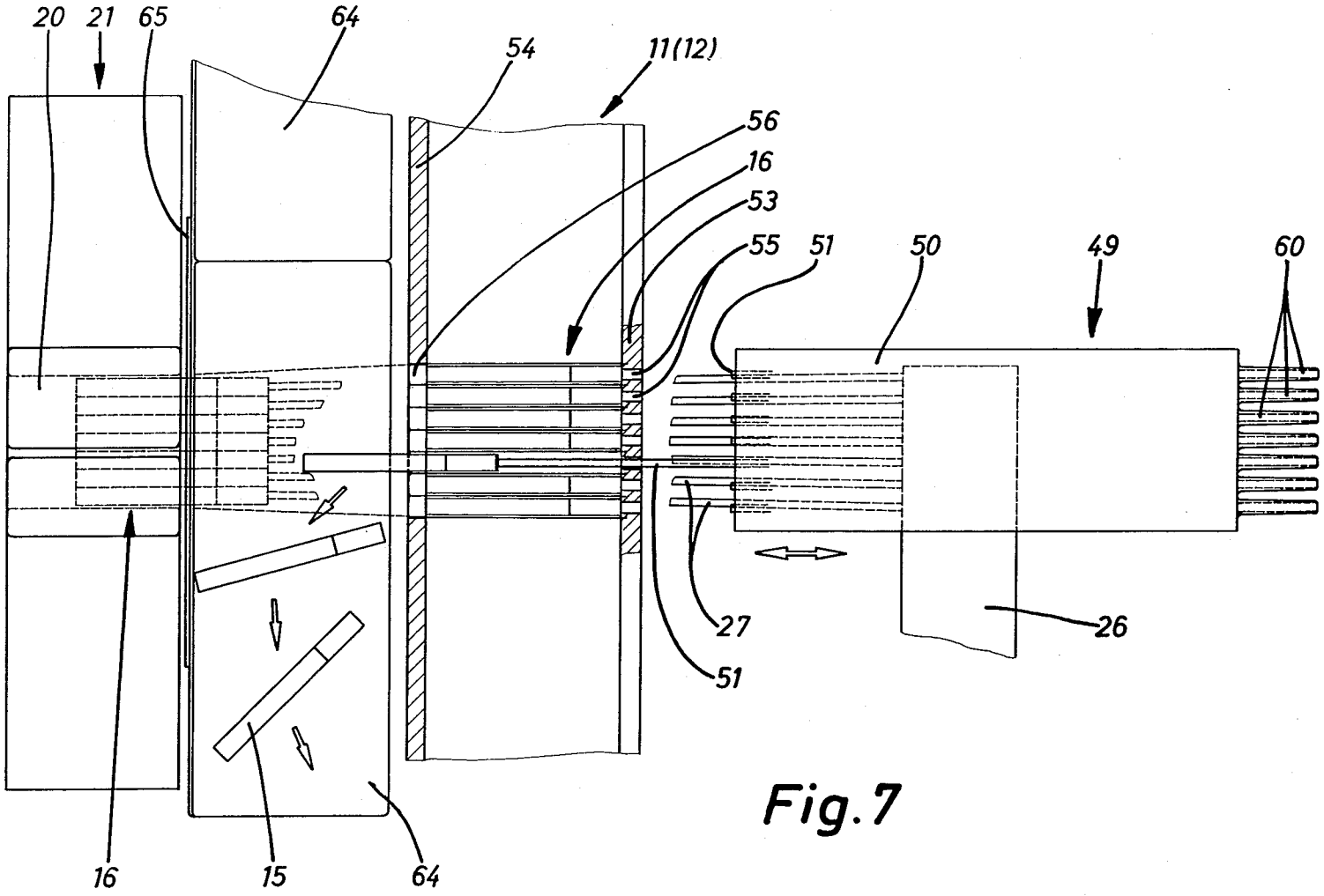
Figure 8:
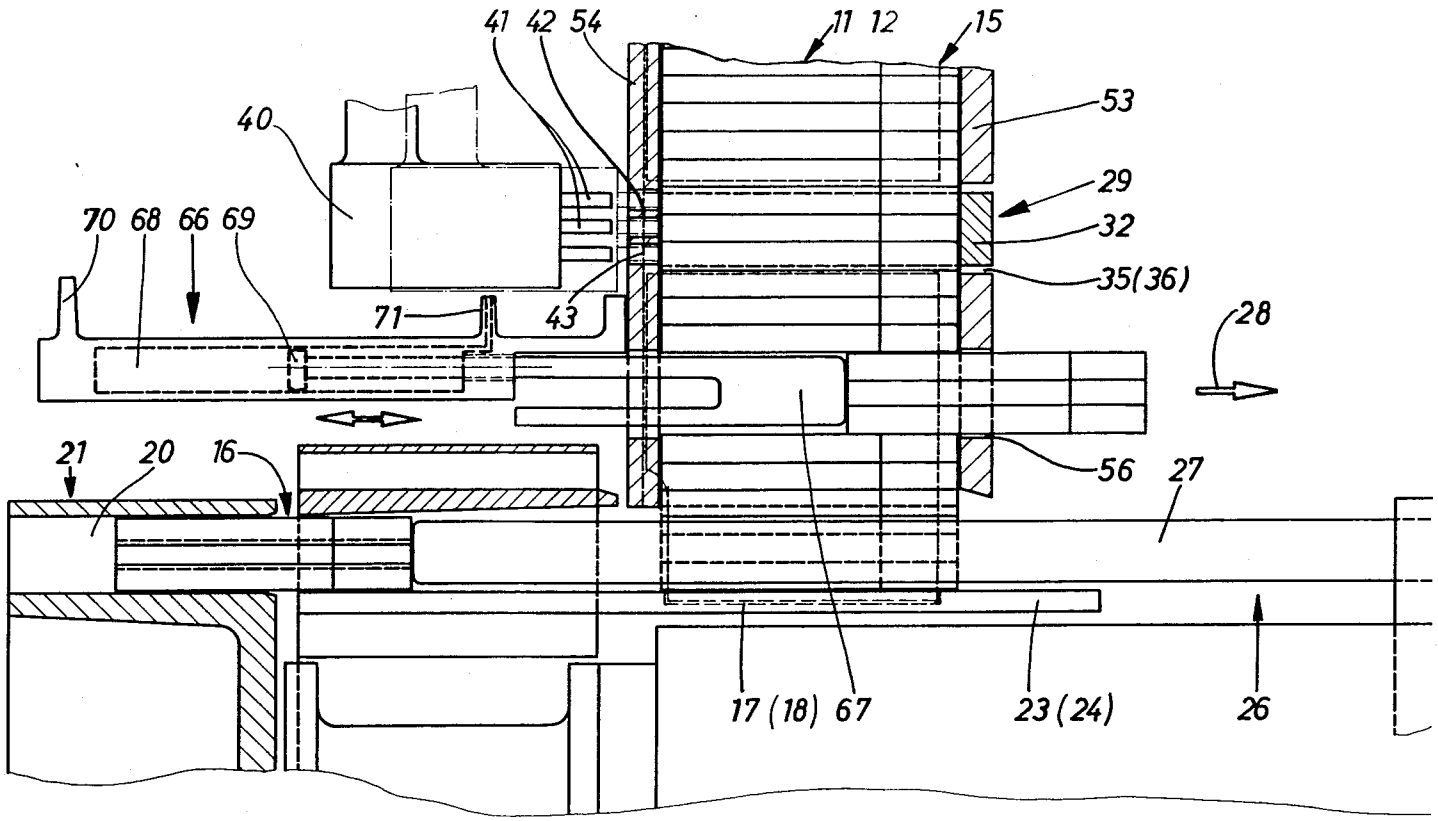
Figure 9:
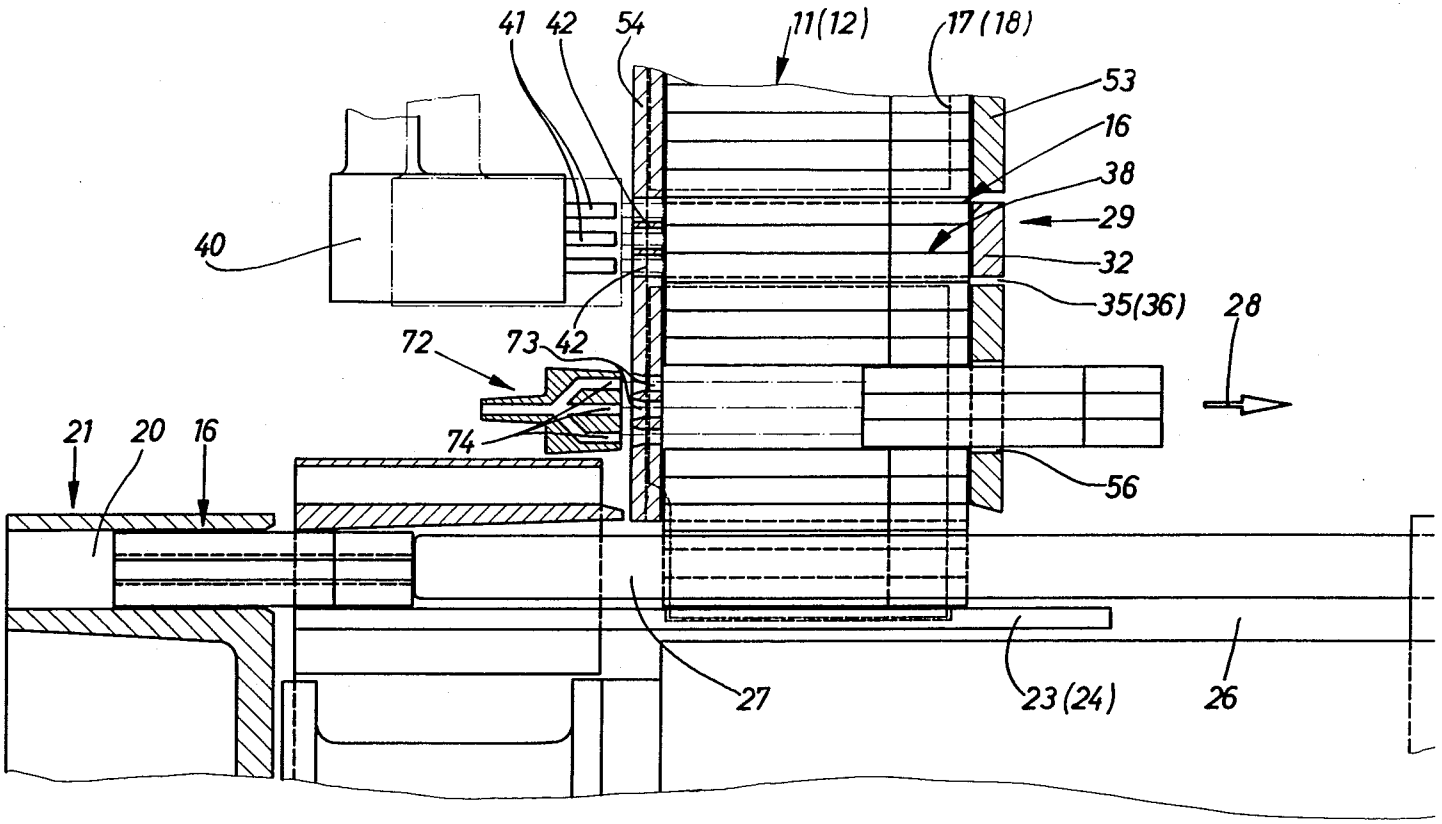

Exemplary embodiments of the apparatus according to the invention are explained in detail below with reference to the drawings. In these drawings:

FIG. 1 shows a front view of part of a cigarette magazine with a cigarette turret, FIG. 2 shows a detail of the illustration in FIG. 1 on an enlarged scale, in particular two shaft groups of the cigarette magazine, FIG. 3 shows a portion of a shaft group as a detail with a transverse slide in the initial position, FIG. 4 shows a representation corresponding to that of FIG. 3 with the transverse slide in the testing position, FIG. 5 shows a horizontal section through a shaft group of the magazine in the region of the transverse slide, FIG. 6 shows a vertical section in the region of a magazine shaft with pushing-out members for cigarettes, FIG. 7 shows a horizontal section through a shaft group in the region of the pushing-out plane for defective cigarettes, FIG. 8 shows a representation similar to that of FIG. 6 of another embodiment of the apparatus, FIG. 9 shows a representation similar to that of FIGS. 6 and 8 of a further embodiment of the apparatus.

In the conventional design of cigarette packaging machines, the cigarettes coming from a cigarette production machine are introduced into a funnel-shaped cigarette magazine 10 assigned to the packaging machine. Of this cigarette magazine 10, FIG. 1 shows a lower part, in particular two shaft groups 11 and 12, each consisting of a number of magazine shafts 13 and 14 leading downwards. As is known, these are designed so that a vertical row 15 of cigarttes is received in each magazine shaft 13, 14. The number of magazine shafts 13, 14 combined into a shaft group 11, 12 corresponds to the number of cigarettes in a layer within a cigarette group 16 intended to be accommodated in a cigarette pack. Accordingly, in the present exemplary embodiment, seven magazine shafts 13, 14 are formed within each shaft group 11, 12. The magazine shafts 13, 14 are separated from one another by thin shaft walls 17, 18. The width or transverse dimension of a magazine shaft 13, 14 is somewhat larger than the diameter of a cigarette.

At the lower end of the shaft groups 11, 12, the cigarette groups 16 are pushed out, in the region of a main pushing-out plane 19, into a pocket 20 of a cigarette turret 21 rotating in a vertical plane next to the shaft groups 11, 12. The cigarette groups are delivered to the packaging machine by this cigarette turret 21, in the present case via a cigarette conveyor 22 which receives the cigarette groups 16.

The rows 15 of cigarettes in the individual magazine shafts 13, 14 rest, in the main pushing-out plane 19, on sloping or roof-shaped pushing-out plates 23, 24. Pushing-out members each push out several, namely three cigarettes lying on top of one another from a magazine shaft 13, 14 through a mouthpiece 25 into the coaxially aligned pocket 20 of the cigarette turret 21.

The pushing-out members for the cigarettes are a cigarette pushing-out device 26 with a number of web-like pushing fingers 27 corresponding to the number of magazine shafts 13, 14 to be emptied. The dimensions of these rectangular pushing-out members are such that the desired number of cigarettes lying on top of one another is picked up from each magazine shaft 13, 14, in the present case three. At the same time, the pushing fingers 27, whilst taking the cigarettes with them, are moved until the cigarette group 16 enters the pocket 20.

The cigarettes are checked for correct formation in the region of the magazine shafts 13, 14. The cigarettes moved downwards under their own weight in batches, in particular three cigarettes at the same time (feed batch), enter a transverse slide 29 in the region of a test plane 28. This transverse slide 29 is designed to resemble a portion or intermediate piece of the shaft group 11, 12. A frame-shaped structure with slide side walls 30 and 31 and a slide rear wall 32 is transversely displaceable within the shaft group 11, 12 in a plane perpendicular to the longitudinal extension of the magazine shafts 15, 14. The dimensions of shaft-group side walls 33 and 34 are such that the transverse slide 29 can execute transverse movements within a recess 35, 36 in the shaft-group side walls 33, 34, specifically in an amount corresponding to half the width of a magazine shaft 13, 14. Inside the transverse slide 29 open at the top and bottom are arranged slide partition walls 37 which, in the initial position of the transverse slide 29 (FIG. 3), are in line with the shaft walls 17, 18, in particular form continuations of these. Accordingly, in this position, the rows 15 of cigarettes run continuously even in the region of the transverse slide 29.

The transverse slide 29 is arranged at a distance from the lower main pushing-out plane 19 (pushing-out plate 23, 24) which corresponds to a multiple of a feed stroke of the cigarettes in the magazine shafts 13, 14. In the present case, the distance amounts to four feed strokes, the length of a feed stroke corresponding to the added diameter of three cigarettes. The (three) cigarettes lying on top of one another in the individual magazine shafts 13 and 14 in the region of the transverse slide 29 are subjected to a test. For this purpose, the transverse slide together with this cigarette group 16 is moved out of the aligned initial position according to FIG. 3 into the testing position according to FIG. 4. Here, the cigarettes located in the transverse slide 29 are offset relative to the rows 15 inside the magazine shafts 13, 14. The arrangement is such that the particular lower cigarettes or a lower layer 38 rest on upper supporting ends 39 of the lower portions of the shaft walls 17, 18. Since the supporting ends 39 are aligned with an exact transverse plane or test plane 28, the cigarettes within the transverse slide 29 are also aligned correspondingly. The cigarette group 16 is now arranged very precisely. A laterally arranged test unit 40 which can be advanced towards the transverse slide 29 in the test position can now test the end faces of the cigarettes 15 exactly in the centre by means of test members, in the present exemplary embodiment by means of mechanical test push rods 41. The transverse slide 29 is equipped, on the side facing the test unit 40, with a thin slide front wall 42 which here has bores 43 for the passage of the test push rods 41.

The transverse slides 29 can be moved by suitable pushing members. In the present exemplary embodiment, the transverse slides 29 are moved by separate actuating members, in particular each by a cam disc 44, 77 driven to rotate. Tracer rollers 45 connected to the transverse slide 29 run on the periphery of the cam discs 44, 77 driven to rotate. By means of elevations on the cam discs 44, 77, the transverse slides 29 are simultaneously moved out of the initial position into the test position. The cam discs 44, 77 are arranged on a common drive shaft 47.

The transverse slides 29 are supported elastically within the shaft walls, in particular by means of restoring springs 46. By means of these, each transverse slide 29 is moved back into the initial position, as soon as the tracer roller 45 leaves the elevation on the cam disc 44, 77.

If defective cigarettes are identified during the test, these are separated out before they reach the lower main pushing-out plane 19. In the exemplary embodiment according to FIGS. 1 and 2, a pushing-out plane 48 for defective cigarettes is located above the main pushing-out plane 19 an amount corresponding to one feed stroke. A pushing-out member 49 is designed so that three cigarettes lying on top of one anoother are pushed out of each cigarette group 16 tested, together with the defective cigarette. In an unfavourable case, therefore, two intact cigarettes are lost together with one defective cigarette.

For this purpose, the pushing-out member 19 consists of an elongated box-shaped holder 50, in which is accommodated a number of pushing-out fingers 51 corresponding to the number of magazine shafts 13, 14 of a shaft 11, 12. Each pushing-out finger 51 is assigned to a magazine shaft 13, 14.

The holder 50 is connected to the cigarette pushing-out device 26 via a web 52 and is accordingly constantly moved to and fro together with the cigarette pushing-out device 26. Insofar as there are no defective cigarettes to be separated out, the pushing-out fingers 51 are in a retracted position within the holder 50, so that they remain outside the shaft groups 11, 12 in the end pushingout position of the cigarette pushing-out device 26. When a defective cigarette is to be separated out (by pushing out three cigarettes), the respective pushing-out finger 51 is extended from the holder 50, in such a way that this pushing-out finger 51 passes through the respective magazine shaft 13, 14, at the same time taking with it three cigarettes lying on top of one another. A shaft rear wall 53 and a shaft front wall 54 are provided with passage slits 55 for the pushing-out fingers 51 or with slit orifices 56 for the passage of the pushed-out cigarettes. In the present exemplary embodiment, the shaft front wall 54 is provided with a continuous orifice which is divided, in this region, into individual slit orifices 56 by the appropriately widened or enlarged shaft walls 17, 18.

In the present case, the pushing-out fingers 51 are are actuated pneumatically. Each pushing-out finger 51 is mounted by means of a piston end 57 in a cavity of the holder 50, in particular a cylinder space 58. Via compressed-air channels 59 and compressed-air lines 60 likewise assigned to each pushing-out finger 51 and each cylinder space 58, single pushing-out fingers 51 can be subjected to compressed air individually, so that they can be moved out of the retracted position (represented by dot-and-dash lines in FIG. 6) in the pushing-out direction (unbroken lines in FIG. 6).

Each compressed-air line 60 is connected to a solanoid valve 61 which responds to signals from the test unit 40.

After a pushing-out movement of a pushing-out finger 51 has been executed, air is removed from the cylinder space 58 by reversing the solanoid valve 61. The respective pushing-out finger 51 is pulled into the initial position by an automatic restoring member, in particular by a restoring tension spring 62. In the compressed position, the restoring tension spring 52, which is especially long, is accommodated in a channel 63 within the pushing-out finger 51.

The movements of the cigarette pushing-out device 26 and of the pushing-out member 49 or pushing-out fingers 51 are coordinated with one another in such a way that any defective cigarettes are separated out in the way described within a short time interval of the cycle of movement of the cigarette pushing-out device 26. For this purpose, the extending movement of the respective pushing-out finger 51 is started by subjecting it to compressed air, as early as immediately after the beginning of the pushing-out movement of the cigarette pushing-out device 26. The pushing-out finger 51 is returned to the initial position, before the pushing fingers 27 of the cigarette pushing-out device 26 come out of the region of the shaft groups 11, 12 during the return movement. This means that, in the magazine shaft 13, 14 with the defective cigarette, the number of cigarettes pushed out is followed up (as a result of the own weight of the cigarettes), even before the number of cigarettes corresponding to the cigarette group 16 pushed out is followed up in all the magazine shafts 13, 14.

In the present exemplary embodiment, the (three) cigarettes separated out pass on to a take-off plate 64 with a vertical stop wall 65. The take-off plate 64 extending next to the two shaft groups 11, 12 is made roof-shaped, so that the cigarettes separated out slide off laterally under their own weight.

FIGS. 8 and 9 illustrate alternatives for separating out defective cigarettes from one or more magazine shafts 13, 14. In both cases, the defective cigarettes are pushed out in the opposite direction to the pushing-out direction for the cigarette groups 16. Accordingly, a pushing-out member 66 is arranged fixedly on the side of the cigarette turret 21, in particular on the shaft front wall 54. Individually moveable pushing-out fingers 67 assigned to the individual magazine shafts 13, 14 are mounted displaceably within the pushing-out member 60 in individual cylinder spaces 68 by means of piston ends 69 and can be subjected to compressed air in both directions of movement via compressed-air connections 70 and 71. In the exemplary embodiment of FIG. 8, only an upper part region of the pushing-out fingers 67 is designed as a piston rod for receiving the piston end 69 as a result of an appropriate reduction in cross-section.

In the alternative according to FIG. 9, the defective cigarettes or a part group of three cigarettes are conveyed out of the respective magazine shaft 13, 14 by means of compressed air. For this purpose, a blowing head 72 can be applied in the region of the shaft front wall 54 and, via blowing bores 73 assigned to each individual cigarette, directs a blowing jet onto each of the cigarettes to be ejected. For this purpose, the blowing head 72 is equipped with nozzles 74 for each cigarette or for each blowing bore 73. The group of three nozzles 74 arranged above one another can be subjected individually to compressed air, so that, here again, any three cigarettes, at least one of which is defective, are conveyed out. The blowing head 72 is designed so that each group of (three) nozzles 74 can be supplied with compressed air individually, and the control can be carried out via solanoid valves, as described in relation to the exemplary embodiment of FIG. 6.

In addition to the testing of the cigarettes in the region of the magazine shafts 13 and 14, in the apparatus illustrated the pushed-out cigarette groups 16 are tested in the region of the cigarette turret 21, specifically by cigarette testing devices 75 and 76 of known design which can be advanced through the pockets 20 of the latter.

We claim:

1. Apparatus for testing cigarettes in the region of vertically inclined, substantially parallel, longitudinal magazine shafts of a cigarette magazine, said apparatus comprising: a cigarette test unit advanceable towards a cigarette group composed of at least one layer ; means for subsequently separating out defective cigarettes; in the region of the magazine shafts (13, 14) defined by shaft walls (17, 18), transverse slide means (29) for containing a cigarette group (16) consisting of at least one layer (38); and means for transversely displacing said slide means relative to the magazine shafts (13, 14), and along a test plane perpendicular to the longitudinal axes of said shafts, from an initial position in said shafts to a test position in which the cigarettes are aligned in layers opposite said test unit, the amount of displacement being approximately equal to half the diameter of a cigarette or half the width of a magazine shaft (13, 14).

2. Apparatus according to claim 1, wherein the transverse slide means (29) is frame-like with slide side walls (30, 31) and subdivisions, corresponding to the magazine shafts, defined by slide partition walls (37) in the plane of said shaft walls (17, 18).

3. Apparatus according to claim 2, wherein, in the test position, said shaft walls (17, 18) have upper supporting ends (39) , aligned in said test plane, for supporting a lowermost layer of the cigarette group within said slide means.

4. Apparatus according to claim 3, wherein said means for displacing said transverse slide means (29) comprises an actuating member formed by a rotating cam disc (44) rotating counter to the load of a restoring spring (46).

5. Apparatus according to claim 4, wherein said cigarette magazine (10) comprises two shaft groups (11, 12); and said apparatus comprises one said transverse slide means (29) for each shaft group, and an actuating member assigned to each of the transverse slide means (29), the two cam discs (44, 77) being arranged on a common drive shaft (47) and having individual tracer rollers (45).

6. Apparatus according to claim 5, comprising means for pushing the defective cigarettes out onto a take-off plate (64) which is located next to the shaft groups (11, 12) and which is roof-shaped, so that the defective cigarettes fall off to the sides.

7. Apparatus according to claim 1, wherein said slide means is sized to contain a cigarette group (16) composed of three layers which are simultaneously displaceable and testable.

8. Apparatus according to claim 1, wherein said slide means (29) has a front wall (42) provided with bores (43) for the passage of test push rods (41) of said test unit.

9. Apparatus according to claim 1, comprising means for pushing out defective cigarettes from the respective magazine shaft (13, 14) in the region of a pushing-out plane (48) located at a distance upstream of a main pushing-out plane (19), where the cigarette groups (16) are packaged, and downstream of said test plane.

10. Apparatus according to claim 9, wherein the cigarettes are fed by intermittent feed strokes through said shafts, and wherein the respective distances between said test plane (28), the pushing out plane (48) for the defective cigarettes, and the main pushing-out plane (19) for the cigarette groups (16) to be packaged, correspond to one or more feed strokes, respectively, of the cigarettes in the magazine shafts (13, 14).

11. Apparatus according to claim 9, comprising: a pushing-out member (49) for defective cigarettes, and coupled to and moveable simultaneously with a cigarette pushing-out device (26) for the cigarette groups (16) to be packaged ; and pushing-out fingers (51) for the defective cigarettes and movable individually relative to the pushing-out member (49) according to the result of the test.

12. Apparatus according to claim 11, comprising means for individually subjecting the pushing-out fingers (51) to compressed air pressure in a holder (50) of the pushing-out member (49), ends of the pushing-out fingers (51) being designed as piston ends (57) and being moveable in individual cylinder chambers (58).

13. Apparatus according to claim 12, comprising elongated restoring tension spring means (62) for moving the pushing-out fingers (51) back into an initial position.

14. Apparatus according to claim 9, comprising a fixed pushing-out member (66), having pushing-out fingers (67) assigned to each magazine shaft (13, 14) and individually actuatable by compressed air, for pushing defective cigarettes out of the magazine shaft (13, 14) in the opposite direction to the pushing-out direction for the cigarette groups (16) to be packaged.

15. Apparatus according to claim 9, comprising: compressed air means for ejecting defective cigarettes from the magazine shaft (13, 14); blowing bores (73), assigned to each cigarette to be blown out, arranged on a shaft rear wall (53) or shaft front wall (54) ; and a nozzle (74) of a blowing head (72) assigned to each blowing bore (73).

16. In a process of testing cigarettes being downwardly transported in vertically inclined, substantially parallel, longitudinal magazine shafts of a cigarette magazine in which horizontally adjacent cigarettes form a cigarette layer, said process including testing at an end of each cigarette in a layer with a cigarette unit located outside the magazine and opposite the ends of cigarettes in the layer, and separating out defective cigarettes after further transport thereof; an improved testing process comprising the steps of:

providing a common testing plane (28) perpendicular to the longitudinal axes of said magazine shafts; and displacing the cigarette layer by an amount corresponding approximately to half the diameter of a cigarette or half the width of a magazine shaft (13), 14), along said testing plane and in a direction transverse to the longitudinal axes of said magazine shafts, from an initial position in said magazine shafts to a test position where said cigarette layer rests on supporting means in said testing plane and with the cigarette ends in the layer in alignment with the test unit.

17. Process according to claim 16, wherein the displacing step comprises displacing the cigarette layer to be tested until the cigarettes in the layer rest on upper supporting ends (39) of magazine shaft walls (17, 18), said upper ends being aligned in said common test plane.

18. Process according to claim 17, wherein said displacing step comprises simultaneously displacing three vertically adjacent cigarette layers, corresponding to the content of a cigarette pack, so that the lower layer (38) rests on said upper supporting ends (39) of the shaft walls (17, 18).

19. Process according to claim 18, comprising, after testing has been carried out, displacing the cigarette layers back into the initial position, so that they are aligned with columns (15) of cigarettes in the magazine shafts (13, 14).

* * * * *